US008341966B2

(12) United States Patent
Braun et al.

(10) Patent No.: US 8,341,966 B2
(45) Date of Patent: Jan. 1, 2013

(54) CLIMATE CONTROL DEVICE

(75) Inventors: Ralf Braun, Herborn (DE); Ralf Schneider, Herborn (DE); Patrick Löffler, Hohenahr (DE)

(73) Assignee: Rittal GmbH & Co. KG, Herborn (DE)

( * ) Notice: Subject to any disclaimer, the term of this patent is extended or adjusted under 35 U.S.C. 154(b) by 619 days.

(21) Appl. No.: 12/311,955

(22) PCT Filed: Oct. 9, 2007

(86) PCT No.: PCT/EP2007/008718

§ 371 (c)(1),
(2), (4) Date: Dec. 21, 2009

(87) PCT Pub. No.: WO2008/055569

PCT Pub. Date: May 15, 2008

(65) Prior Publication Data

US 2010/0107655 A1 May 6, 2010

(30) Foreign Application Priority Data

Nov. 6, 2006 (DE) ..... 10 2006 052 122

(51) Int. Cl.
*F25B 21/02* (2006.01)

(52) U.S. Cl. ..... 62/3.3; 62/3.61

(58) Field of Classification Search ..... 62/3.3, 62/3.5, 3.61, 419; 165/148
See application file for complete search history.

(56) References Cited

U.S. PATENT DOCUMENTS

| | | | | |
|---|---|---|---|---|
| 5,385,382 | A * | 1/1995 | Single et al. | 297/180.13 |
| 5,626,021 | A * | 5/1997 | Karunasiri et al. | 62/3.5 |
| 6,567,262 | B2 * | 5/2003 | Meir | 361/676 |
| 7,877,827 | B2 * | 2/2011 | Marquette et al. | 5/423 |
| 2003/0029175 | A1 | 2/2003 | Lee | |
| 2003/0145605 | A1 | 8/2003 | Moon et al. | |
| 2006/0016588 | A1 * | 1/2006 | Haglsperger et al. | 165/202 |
| 2006/0117761 | A1 | 6/2006 | Bormann | |
| 2006/0137359 | A1 | 6/2006 | Ghoshal | |

FOREIGN PATENT DOCUMENTS

| | | |
|---|---|---|
| DE | 6901069 | 1/1969 |
| JP | 2005155983 A | 6/2005 |

* cited by examiner

*Primary Examiner* — Melvin Jones
(74) *Attorney, Agent, or Firm* — Pauley Petersen & Brickson

(57) ABSTRACT

A climate control device having a cooling air outlet for cooled air, and a heated air outlet for heated air, wherein the air to be cooled is cooled by a cold side of a Peltier element arrangement and is blown out by a cooling air feed device via the cooled air outlet, and wherein the air to be heated is heated by a warm side of the Peltier element arrangement and is blown out by a heated air feed device via the heated air outlet. Each of the warm side and/or the cold side of the Peltier element arrangement is coupled to a coolant circuit, to which an air/fluid heat exchanger arrangement is connected. The device is used, for example, for cooling or ventilating a housing, particularly of a control cabinet.

40 Claims, 3 Drawing Sheets

CLIMATE CONTROL DEVICE

BACKGROUND OF THE INVENTION

1. Field of the Invention

This invention relates to a climate control device, having a cool air outlet for cooled air and a warm air outlet for warmed air. The air to be cooled is cooled in the cold side of a Peltier element arrangement and is blown out by a cool air conveying device through the cool air outlet. The air to be warmed is heated by the warm side of the Peltier element arrangement and is blown out by a warm air conveying device through the warm air outlet.

2. Discussion of Related Art

In the prior art, climate control devices for housings, for example switchgear cabinet housings, are known, in which several Peltier elements which, when triggered electrically, respectively have a cold and a warm side, are arranged in the form of an array for increasing output. Fans are arranged on the cold side of this Peltier element arrangement, which convey the air to be cooled out of the interior of the housing and past the cold side.

Then the cooled air is blown through an outlet opening back into the space which is to be cooled. Fans are arranged on the warm side of this Peltier element arrangement, which convey ambient air past the warm side. The ambient air absorbs heat and is then blown back outside through an outlet opening.

The heat transfer between the air conveyed past the Peltier element arrangement and the cold, or respectively warm side of this arrangement, is limited. The cause of this is the limited heat absorption, or respectively heat absorption capability, of the air, and also the relatively high flow speed of the conveyed air. However, since, for example in switchgear cabinets, the stacking density of installed electronic devices continues to increase, and thus an increased cooling requirement of the installed devices exists, the cooling effect of the known climate control devices is no longer sufficient.

With the known climate control device, an improvement in the heat transfer can only be achieved by a more elaborate guidance of the air and a Peltier element arrangement of larger dimensions. Thus the costs of such a climate control device are considerably increased. Furthermore, a compact structure, such as is necessary in switchgear cabinet technology, for example, can no longer be provided by the known climate control device.

Also used as a cooling device, a climate control device can be used in a different capacity, depending on the connection of the lines conducting the air, as a heating device. In this case, the heating effect of the warm side of the Peltier element arrangement is used for heating the air. But, besides the limited cooling effect, the known climate control device only has a limited heating effect when used as a heating device.

SUMMARY OF THE INVENTION

It is one object of this invention to provide a climate control device with an improved heat transfer from the Peltier element arrangement to the conveyed air. Also, the climate control device in accordance with this invention can have a more compact and cost-effective structure and to have diverse employment options.

Also, a housing having a climate control device in accordance with this invention is disclosed.

The object of this invention is achieved with a climate control device having characteristics and further developments described in this specification and in the claims.

In a first basic concept of this invention, when operating the climate control device as a cooling device the cold side of the Peltier element arrangement is connected to an assigned coolant circuit for cooling the coolant conducted in it. In turn, an air/liquid heat exchanger arrangement for the air to be cooled is connected to the coolant circuit. The cool air conveying device is connected in an air-conducting manner with the air/liquid heat exchange arrangement and the cool air outlet, so that the cool air conveying device conducts the air to be cooled through the air/liquid heat exchanger arrangement for transferring heat to the coolant and blows it out through the cool air outlet.

A heat transfer from the coolant, which has a better heat-transfer ability than air, takes place at the cold side of the Peltier element arrangement.

In the cooling circuit the coolant, effectively thus cooled, is conducted to an air/liquid heat exchanger arrangement, at which a good heat transfer from the air to be cooled again takes place. As a result, the air to be cooled is particularly effectively cooled by this arrangement.

When employing the climate control device as a cooling device it is necessary to remove the heat at the warm side of the Peltier element arrangement. This can take place in a customary way by direct radiation to the exterior, or with the aid of a suitable fan arrangement.

It is possible to achieve an improved heat removal at the warm side of the Peltier element arrangement, and therefore an even more improved cooling effect of the climate control device, so that the warm side of the Peltier element arrangement is also connected to an assigned coolant circuit for heating the coolant conducted through the latter. An air/liquid heat exchanger arrangement for the air to be heated is connected to this coolant circuit. The warm air conveying device is connected in an air-conducting manner with the air/liquid heat exchanger arrangement and the warm air outlet, so that the warm air conveying device conducts the air to be heated through the air/liquid heat exchanger arrangement for absorbing heat from the coolant and blows it out through the warm air outlet.

In a second concept of this invention, when employing the climate control device as a heating device, the warm side of the Peltier element arrangement is connected to an associated coolant circuit for heating the coolant therein conducted. An air/liquid heat exchanger arrangement for the air to be heated is connected to the coolant circuit. The warm air conveying device is connected in an air-conducting manner with the air/liquid heat exchanger arrangement and warm air outlet, so that the warm air conveying device conducts the air to be heated through the air/liquid heat exchanger arrangement for taking up heat from the coolant and blows it out through the warm air outlet.

A heat transfer to a coolant, which has a better heat-transfer ability than air, takes place on the warm side of the Peltier element arrangement. In the cooling circuit the coolant, thus effectively heated, is conducted to an air/liquid heat exchange arrangement, at which a good heat transfer to the air to be heated again takes place. As a result, the air to be heated is particularly effectively heated by this arrangement.

When employing the climate control device as a heating device it is necessary to absorb heat at the cold side of the Peltier element arrangement. This can take place in a customary way by direct contact with the exterior or with a suitable fan arrangement.

It is possible to achieve an improved heat transfer to the cold side of the Peltier element arrangement, and therefore an even more improved heating effect of the climate control device so that the cold side of the Peltier element arrangement is connected to an assigned coolant circuit for cooling the coolant conducted through the latter. An air/liquid heat exchanger arrangement for the air to be cooled is connected to the coolant circuit. The cool air conveying device is connected in an air-conducting manner with the air/liquid heat exchanger arrangement and the cool air outlet, so that the cool air conveying device conducts the air to be cooled through the air/liquid heat exchanger arrangement for giving off heat to the coolant and blows it out through the cool air outlet.

In accordance with one embodiment of this invention, the coolant circuit assigned to the cold side of the Peltier element arrangement and the coolant circuit assigned to the warm side of the Peltier element arrangement can be arranged spatially and thermally separated from each other, and each one closed in itself.

The coolant can circulate in the coolant circuits by the inherent dynamics of the warm liquid or the cold liquid. It is possible to achieve an improved heat/cold transport through the coolant if a first pump device is arranged in the coolant circuit assigned to the cold side of the Peltier element arrangement. It is also possible to arrange a second pump device in the coolant circuit assigned to the warm side of the Peltier element arrangement.

The air to be cooled can be conveyed in a simple manner if the cool air conveying device has a first inlet opening for air to be cooled and a first fan arrangement. In this case, a radial fan can be employed which allows a compact structure. It is also possible to convey air to be heated in a simple manner if the warm air conveying device has a second inlet opening for air to be heated, and there is a second fan arrangement comprising a radial fan. Each fan arrangement can be controlled individually or mutually.

The Peltier element arrangement can be constructed in the form of a flat array of a plurality of individually electrically contacted Peltier elements for increasing its output. In this case, the individual Peltier elements are arranged in series next to each other, and a plurality of these rows are arranged parallel with respect to each other. With this arrangement, the individual Peltier elements can be triggered individually or mutually by a suitable control circuit.

A particularly compact construction can be realized if the Peltier element arrangement is arranged between the coolant circuit assigned to the cold side of the Peltier element arrangement and the coolant circuit assigned to the warm side of the Peltier element arrangement.

In an advantageous way, resulting in small dimensions, it is possible to respectively embody the coolant circuit assigned to the cold side of the Peltier element arrangement and the coolant circuit assigned to the warm side of the Peltier element arrangement substantially in a linearly extending manner. In this case, the two coolant circuits can extend substantially parallel in relation to each other. A linearly extending compact construction is thus possible.

In accordance with one preferred embodiment, the climate control device can have a first and a second connection area. In this case, the Peltier element arrangement in the first connection area can be arranged at one end of the coolant circuit assigned to the cold side of the Peltier element arrangement and can be thermally connected with the cold side of the Peltier element arrangement. It is also possible to arrange the Peltier element arrangement in the second connection area at an end of the coolant circuit assigned to the warm side of the Peltier element arrangement and to thermally connect it with the warm side of the Peltier element arrangement.

The first pump device can be arranged in a first pump area adjoining the first connection area. The second pump device can be additionally or alternatively arranged in a second pump area adjoining the second connection area.

The first fan arrangement can be arranged in a first fan area adjoining the first pump area. The second fan arrangement can be arranged additionally or alternatively in a second fan area adjoining the second pump area.

The air/liquid heat exchanger arrangement for the air to be cooled can be arranged in a first heat exchanger area adjoining the first fan area. The air/liquid heat exchanger arrangement for the air to be warmed can be arranged additionally or alternatively in a second heat exchanger area adjoining the second fan area.

The cool air outlet can be arranged adjoining the first heat exchanger area. Additionally or alternatively, the warm air outlet can be arranged for adjoining the second heat exchanger area.

For a compact and functionally dependable construction, it is possible to arrange the Peltier element arrangement between the first connection area and the second connection area. In this case, each of the first connection areas and second connection areas, first pump areas and second pump areas, first fan areas and second fan areas and first heat exchanger areas and second heat exchanger areas adjoins each other.

In accordance with a still further preferred embodiment it is possible for the coolant circuit assigned to the cold side of the Peltier element arrangement to be arranged in a first partial housing. It is additionally or alternatively possible to arrange the coolant circuit assigned to the warm side of the Peltier element arrangement in a second partial housing. Components which are easy to manufacture and easy to manipulate are thus created.

If the first partial housing is arranged parallel with respect to the second housing and adjoining it, the first partial housing, together with the second partial housing, forms a combined housing forming a single device unit of the climate control device. This type of construction of the apparatus makes possible a partial installation in or on housings, cabinets, spaces or other closed systems.

Here, the first connection area, the first pump area, the first fan area and the first heat exchanger area can be arranged in a first partial housing. Additionally or alternatively, the second connection area, the second pump area, the second fan area and the second heat exchanger area can be arranged in a second partial housing.

In accordance with one embodiment of this invention which is easy to produce by manufacturing technology, the arrangement of the first connection area, the first pump area, the first fan area and the first heat exchanger area can be arranged mirror-symmetrically with respect to the second connection area, the second pump area, the second fan area or respectively the second heat exchanger area.

In accordance with a further basic concept of this invention, a housing with at least one climate control device can be equipped as the cooling device. In this connection, at least one wall of the housing has a passage at which the climate control device is arranged. The air to be cooled is conveyed out of the interior of the housing by the cool air conveying device and is again blown back into the interior of the housing through the cool air outlet. Ambient air is conveyed out of the exterior chamber of the housing and is blown out into the exterior chamber of the housing through the warm air outlet.

To prevent a mutual effect on the air flows, the first inlet opening for the air to be cooled and the cool air outlet can be spaced apart from each other and open toward the interior of the housing. Similarly, the second inlet opening for the ambient air and the warm air outlet can be spaced apart from each other and open toward an exterior of the housing.

In accordance with a still further basic concept of this invention, a housing with at least one climate control device can be equipped as a heating device. In this case, at least one of the walls of the housing has a passage, in which the climate control device is arranged. In this case, the air to be heated is conveyed out of the interior of the housing by the warm air conveying device and is blown into the interior of the housing through the warm air outlet.

In order to prevent a mutual effect on the air flows, the second inlet opening for the air to be heated and the warm air outlet can be spaced apart from each other and be open toward the interior of the housing.

BRIEF DESCRIPTION OF THE DRAWINGS

This invention is explained in greater detail in view of a preferred embodiment, making reference to the attached drawings, wherein.

DETAILED DESCRIPTION OF THE INVENTION

Figure 1:
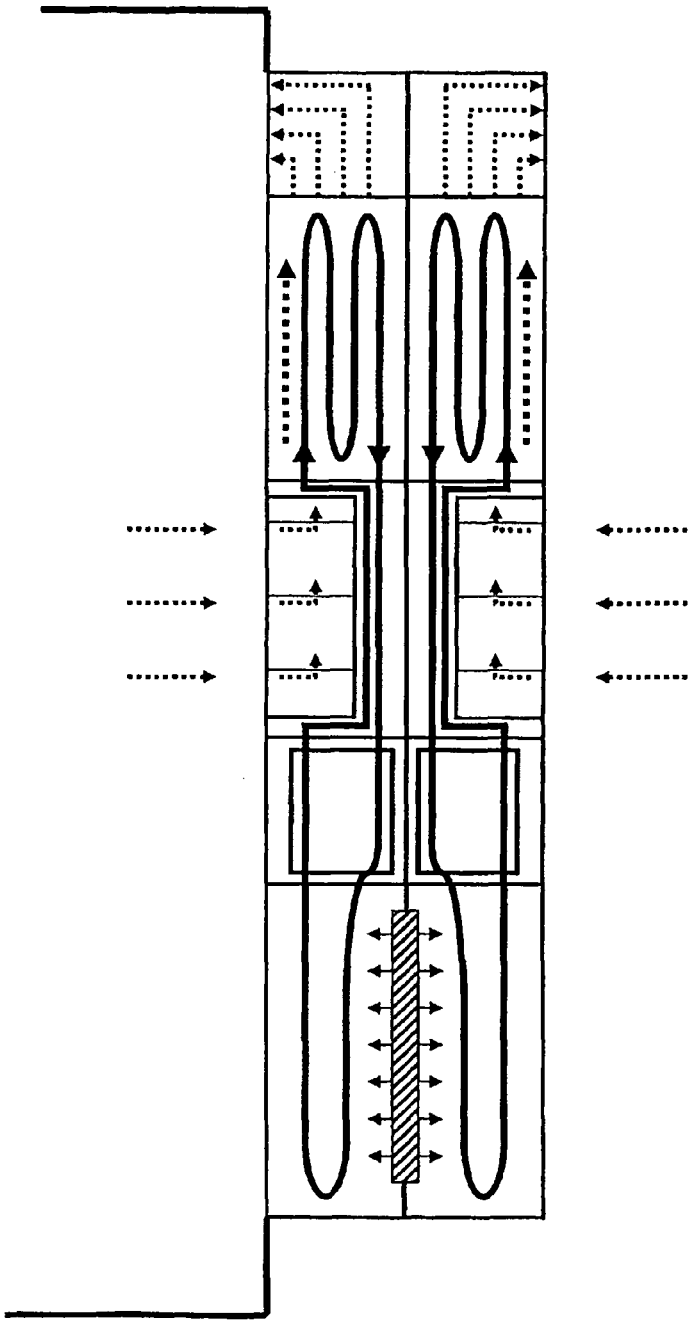
FIG. 1 is a schematic top view in section of a climate control device attached to a wall of a switchgear cabinet housing.
Figure 2:
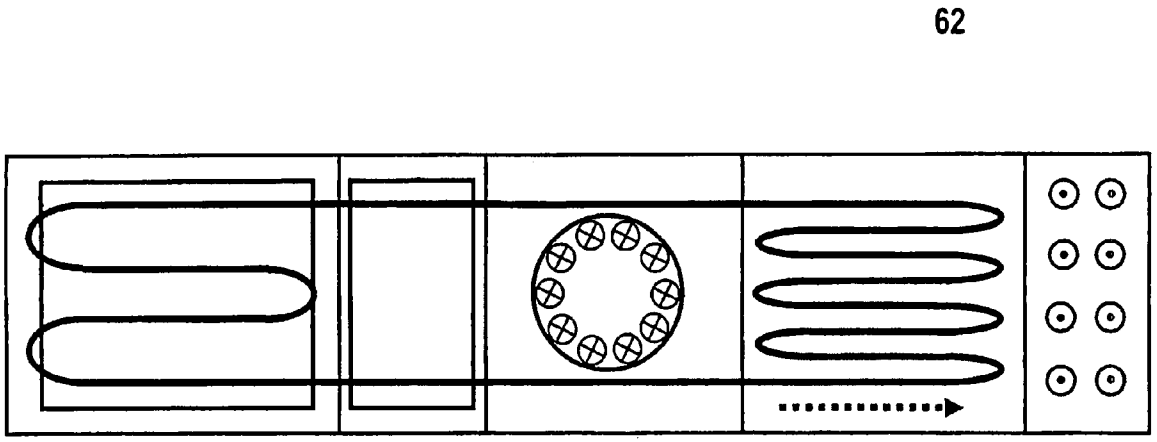
FIG. 2 shows the climate control device in a schematic view from a top section in FIG. 1 in the direction of the side pointing to the right in FIG. 1 into an exterior chamber of the housing.
Figure 3:
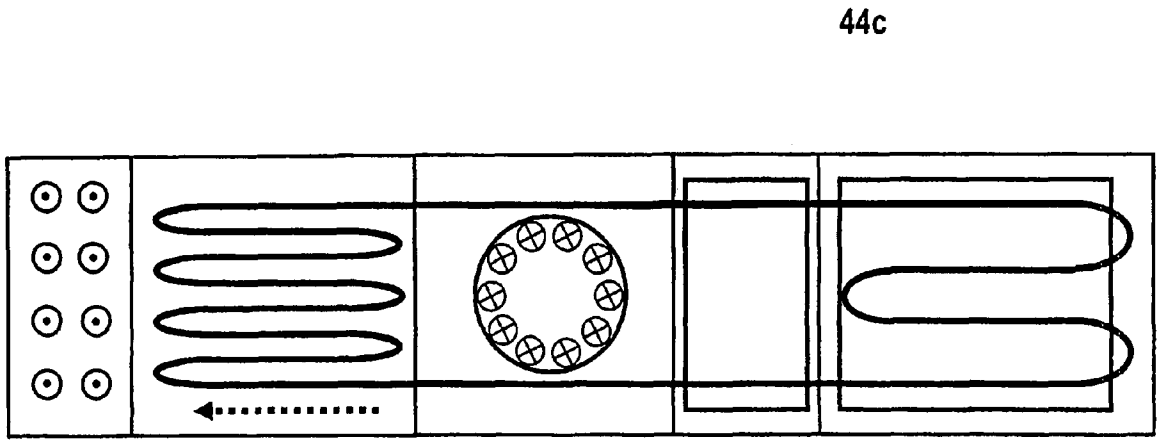
FIG. 3 shows the climate control device in a schematic top view in section in FIG. 1 in the direction of the side pointing to the left in FIG. 1 into the interior chamber of the housing.

The climate control device shown in FIGS. 1 to 3 is arranged in a passage 64 in a back wall 60 of a switchgear cabinet housing 62. The climate control device conveys the air 14*a* to be cooled out of the interior 66 of the housing 62 and then blows the cooled air 12*a* back into the interior 66 of the housing 62. The ambient air 12*b* is conveyed out of the exterior chamber 68 of the housing 62.

The climate control device has a combined housing 48, which is constructed from two partial housings 46*a* and 46*b*, which extend parallel with each other and adjoin each other. A Peltier element arrangement 18 is arranged in the area 38*a*, or respectively 38*b*, at the bottom in the representation in FIG. 1, and is constructed as a flat array of a plurality of individually electrically contacted Peltier elements. The Peltier element arrangement 18 has a cold side 16*a* pointed in the direction toward the partial housing 46*a* and a warm side 16*a* pointed in the direction of the partial housing 46*b*. The Peltier element arrangement 18 is electrically triggered by an electronic control device, not represented.

In what follows, that portion of the climate control device will be described which, in the representation in FIG. 1, is arranged in the left, first partial housing 46*a*. The first partial housing 46*a* is also represented in FIG. 3 in the direction of the side which, in FIG. 1, points to the left, toward the interior 66 of the housing 62.

A coolant circuit 22*a* assigned to the cold side 16*a* of the Peltier element arrangement 18 is arranged in the first partial housing 46*a*. At the end 36*a* which is lower in FIG. 1, the Peltier element arrangement 18 is thermally connected in the connection area 38*a* to the coolant circuit 22*a* for cooling the coolant 24*a* conducted therein. The coolant circuit 22*a* is closed in itself and is embodied to be substantially extending along a vertical direction.

A first pump device 30*a* is arranged in the coolant circuit 22*a* in a first pump area 40*a* adjoining the first connection area 38*a*, or respectively arranged above it in the representation of FIG. 1. The first pump area 40*a* is spatially separated from the first connection area 38*a*. The first pump device 30*a* recirculates the coolant 24*a*, which was cooled at the cold side of the Peltier element arrangement 18, in the coolant circuit 22*a*.

In FIG. 1, a cool air conveying device 20*a* with a first radial fan arrangement 34*a* is arranged above the first pump area 40*a* and adjoining it in a first fan area 42*a*. The first fan area 42*a* is spatially separated in an airtight manner from the first pump area 40*a*. A first air inlet opening 32*a* is attached to the first partial housing 46*a* in the first fan area 42*a*. With the radial fan arrangement 34*a*, the air to be cooled is aspirated through the inlet opening 32*a*, from the left in the representation in FIG. 1, from the interior 66 of the housing 62 and, in the representation of FIG. 1, is further conveyed upward in a vertical direction.

In a first heat exchanger area 44*a*, there is an air/liquid heat exchanger arrangement 28*a* for the air to be cooled in the coolant circuit 22*a* adjoining the first fan area 42*a*, or respectively on top of it in the representation of FIG. 1. The first heat exchanger area 44*a* is connected in an air-conducting manner with the first fan area 42*a*, so that the air vertically conveyed by the cool air conveying device 20*a* can flow into the heat exchanger area 44*a* unhampered. The air 14*a* to be cooled, aspirated by the radial fan arrangement 34*a*, is conveyed through the heat exchanger area 44*a* and gives off its heat to the coolant 24*a* in the heat exchanger arrangement 28*a*.

In the representation in FIG. 1, a cool air outlet 10*a* is arranged, connected in an air-conducting manner with the air/liquid heat exchanger arrangement 28*a* and the cool air conveying device 20*a*, above the first heat exchanger area 44*a*. The cooled air 12*a* is blown through the cool air outlet 10*a* in the direction of the interior 66 of the housing 62 by the cool air conveying device 20*a*. The cool air outlet 10*a* and the first inlet opening 32*a* for the air to be cooled are both open toward the interior 66 of the housing 62 and are designed to be separated by the heat exchanger area 44*a*.

The portion of the climate control device arranged in the representation of FIG. 1 in the right, second partial housing 46*b*, will be described in what follows. The second partial housing 46*b* is also represented in FIG. 2 in the direction of the side which, in FIG. 1, points toward the right, toward the exterior 68 of the housing 62.

A coolant circuit 22*b* is arranged in the second partial housing 46*b* and is assigned to the warm side 16*b* of the Peltier element arrangement 18.

At the lower end 36*b* in FIG. 1, the Peltier element arrangement 18 is thermally connected in the connection area 38*b* to the coolant circuit 22*b* in order to give off heat to the coolant 24*b* therein conducted. The coolant circuit 22*b* is closed in itself and is substantially extending along a vertical direction.

A second pump device 30*b* is arranged in the coolant circuit 22*b* in a second pump area 40*b* adjoining the second connection area 38*b*, or respectively arranged above it in the representation of FIG. 1. The second pump area 40*b* is spatially separated from the second connection area 38*b*. The second pump device 30*b* recirculates the coolant 24*b*, which was heated at the warm side 16*b* of the Peltier element arrangement 18, in the coolant circuit 22*b*.

In FIG. 1, a heating air conveying device 20*b* with a second radial fan arrangement 34*b* is arranged above the second pump area 40*b* and adjoining it in a second fan area 42*b*. The second fan area 42*b* is spatially separated in an airtight manner from the second pump area 40*b*. A second air inlet opening 32*b* is attached to the second partial housing 46*b* in the second fan area 42*b*. With the radial fan arrangement 34*ba*, the air 14*b* is aspirated through the inlet opening 32*a*, from the left in the representation in FIG. 1, from the interior 66 of the housing 62 and, in the representation of FIG. 1, is further conveyed upward in a vertical direction.

In a second heat exchanger area 44*b*, an air/liquid heat exchanger arrangement 28*b* for the air to be cooled is provided in the coolant circuit 22*b* adjoining the second fan area 42*b*, or respectively on top of it in the representation of FIG. 1. The second heat exchanger area 44*b* is connected in an air-conducting manner with the second fan area 42*b*, so that the air vertically conveyed by the heating air conveying device 20*b* can flow unhampered into the heat exchanger area 44*b*. The air 14*b* to be cooled, aspirated by the radial fan arrangement 34*b*, is conveyed through the heat exchanger area 44*b* and gives off its heat to the coolant 24*b* in the heat exchanger arrangement 28*b*.

In the representation in FIG. 1, a warm air outlet 10*b* is arranged, connected in an air-conducting manner with the air/liquid heat exchanger arrangement 28*b* and the heating air conveying device 20*b*, above the second heat exchanger area 44*b*. The heated air 12*b* is blown through the heating air outlet 10*b* in the direction of the interior 66 of the housing 62 by the heating air conveying device 20*b*. The heating air outlet 10*b* and the second inlet opening 32*b* for the air to be heated are both open toward the exterior 68 of the housing 62 and are separated by the second heat exchanger area 44*b*.

The coolant circuit 22*a* assigned to the cold side 16*a* of the Peltier element arrangement 18 and arranged in the first partial housing 46*a*, and the coolant circuit 22*b* assigned to the warm side 16*b* of the Peltier element arrangement 18 and arranged in the second partial housing 46*b*, are spatially and thermally separated from each other and each closed in itself. The coolant circuit 22*a* and the coolant circuit 22*b* extend substantially parallel with respect to each other.

The Peltier element arrangement 18 is arranged between the coolant circuit 22*a* in the first connection area 38*a* and the coolant circuit 22*b* second connection area 38*b*.

The first connection area 38*a* and the second connection area 38*b*, the first pump area 40*a* and the second pump area 40*b*, the first fan area 42*a* and the second fan area 42*b*, and the first heat exchanger area 44*a* and the second heat exchanger area 44*b* each adjoin each other.

The first pump device and the second pump device are driven independently of each other and are electrically triggered by a control circuit, not represented. Alternatively, the first pump device and the second pump device can be driven together.

The first fan arrangement and the second fan arrangement are driven independently of each other and are electrically triggered by a control circuit, not represented. Alternatively, the first fan arrangement and the second fan arrangement can also be driven together.

The arrangement of the first connection area 38*a*, the first pump area 40*a*, the first fan area 42*a* and the first heat exchanger area 44*a* can be mirror-reversed in relation to the second connection area 38*b*, the second pump area 40*b*, the second fan area 42*b*, or respectively the second heat exchanger area 44*b*. Here, a plane defined by the Peltier element arrangement 18 constitutes or forms the plane of symmetry 50.

In the embodiment represented, the climate control device described above by FIGS. 1 to 3 is employed as a cooling device for the interior 66 of the switchgear cabinet 62.

In an alternative embodiment, not represented, the climate control device can also be used as a heating device for an enclosed space or a housing.

In this case, the connectors of the climate control device for conveying air are differently connected in comparison with the embodiment represented in FIGS. 1 to 3.

In a heating device, the air to be warmed is conducted out of the interior of the space to be heated, or of the housing, by the warm air conveying device and is again blown into the interior of the space or the housing through the warm air outlet. Thus, for a heating device, for example represented in FIG. 1, the second inlet opening 32*b* for the heated air, and the warm air outlet 10*b* are connected with the interior of the space or the housing. The inlet opening 32 and the cool air outlet 10*a* are connected with the exterior chamber.

In a further alternative but not shown embodiment, the cool air outlet 10*a* and the warm air outlet 10*b* can be connected with a common mixing chamber, or a like mixing device, in order to make available, as a function of the amounts of air supplied by both sides, an airflow of a mixing air temperature. In addition, an electronic temperature control or regulating device can be employed.

Finally, in accordance with a further not shown embodiment it is possible to omit either the arrangement shown for example in FIG. 1 in the first partial housing 46*a* in connection with a use as a heating device, or the arrangement in the second partial housing 46*b* in connection with a use as a cooling device, and to replace it with an alternative arrangement. For example, a simple arrangement of fans can be alternatively employed for the desired heat transfer on the non-used side.

The above described climate control device can, for example, be employed in connection with the climate control of switchgear cabinets, as a cooling device for CPUs, as an air dehumidifier, in climate control arrangements in motor vehicles or rooms, or for climate control of individual objects.

The invention claimed is:

1. A climate control device, having a cool air outlet (10*a*) for cooled air (12*a*) and a warm air outlet (10*b*) for warmed air (12*b*), wherein air to be cooled (14*a*) is cooled in a cold side (16*a*) of a Peltier element arrangement (18) and is blown out by a cool air conveying device (20*a*) through the cool air outlet (10*a*), and the air to be warmed (14*b*) is heated by a warm side (16*b*) of a Peltier element arrangement (18) and is blown out by a warm air conveying device (20*b*) through the warm air outlet (10*b*), the climate control device comprising:

the cold side (16*a*) of the Peltier element arrangement (18) connected to an assigned coolant circuit (22*a*) for cooling the coolant (24*a*) therein conducted, an air/liquid heat exchanger arrangement (28*a*) for the air (14*a*) to be cooled connected to the coolant circuit (22*a*), the cool air conveying device (20*a*) connected in an air-conducting manner with the air/liquid heat exchanger arrangement (28*a*) and the cool air outlet (10*a*), the cool air conveying device (20*a*) conducting the air (14*a*) to be cooled through the air/liquid heat exchanger arrangement (28*a*) for transferring heat to the coolant (24*a*) and blowing out through the cool air outlet (10*a*).

2. The climate control device in accordance with claim 1, wherein the warm side (16*b*) of the Peltier element arrangement (18) is connected to an assigned coolant circuit (22*b*) for heating the coolant (26*b*) conducted therein, an air/liquid heat exchanger arrangement (28) for the air (14*b*) to be heated is connected to the coolant circuit (22*b*), and the warm air conveying device (20*b*) is connected in an air-conducting manner with the air/liquid heat exchanger arrangement (28*b*) and the warm air outlet (10*b*), wherein the warm air conveying device (20*b*) conducts the air (14*b*) to be heated through the air/liquid heat exchanger arrangement (28*b*) for absorbing heat from the coolant (26*b*) and blowing out through the warm air outlet (10*b*).

3. A climate control device, having a cool air outlet (10*a*) for cooled air (12*a*) and a warm air outlet (10*b*) for warmed air (12*b*), wherein air to be cooled (14*a*) is cooled in a cold side (16*a*) of a Peltier element arrangement (18) and is blown out by a cool air conveying device (20*a*) through the cool air outlet (10*a*), and the air to be warmed (14*b*) is heated by a warm side (16*b*) of a Peltier element arrangement (18) and is blown out by a warm air conveying device (20*b*) through the warm air outlet (10*b*), the climate control device comprising:

the warm side (16*b*) of the Peltier element arrangement (18) connected to an associated coolant circuit (22*b*) for heating the coolant (26*b*) therein conducted, an air/liquid heat exchanger arrangement (28*b*) for the air (14*b*) to be heated connected to the coolant circuit (22*b*), the warm air conveying device (20*b*) connected in an air-conducting manner with the air/liquid heat exchanger arrangement (28*b*) and the warm air outlet (10*b*), wherein the warm air conveying device (20*b*) conducts the air (14*b*) to be heated through the air/liquid heat exchanger (28*b*) arrangement for taking up heat from the coolant (26*b*) and blowing out through the warm air outlet (10*b*).

4. The climate control device in accordance with claim 3, wherein the cold side (16*a*) of the Peltier element arrangement (18) is connected to an assigned coolant circuit (22*a*) for cooling the coolant conducted (24*a*) therein, an air/liquid heat exchanger arrangement (28*a*) for the air (14*a*) to be cooled is connected to the coolant circuit (22*a*), and the cool air conveying device (20*a*) is connected in an air-conducting manner with the air/liquid heat exchanger arrangement (28*a*) and the cool air outlet (10*a*), wherein the cool air conveying device (20*a*) conducts the air (14*a*) to be cooled through the air/liquid heat exchanger arrangement (28*a*) for giving off heat to the coolant (24*a*) and blowing out through the cool air outlet (10*a*).

5. The climate control device in accordance with claim 4, wherein the coolant circuit (22*a*) assigned to the cold side (16*a*) of the Peltier element arrangement (18) and the coolant circuit (22*b*) assigned to the warm side (16*b*) of the Peltier element arrangement (18) are arranged spatially and thermally separated from each other, and each one is closed in itself.

6. The climate control device in accordance with claim 5, wherein a first pump device (30*a*) is arranged in the coolant circuit (22*a*) assigned to the cold side (16*a*) of the Peltier element arrangement (18), and/or a second pump device (30*a*) is arranged in the coolant circuit (22*b*) assigned to the warm side (16*b*) of the Peltier element arrangement (18).

7. The climate control device in accordance with claim 6, wherein the cool air conveying device (20*a*) has a first inlet opening (32*a*) for the air (14*a*) to be cooled and a first fan arrangement (34*a*) and/or the warm air conveying device (20*b*) has a second inlet opening (32*b*) for air (14*b*) to be heated, and a second fan arrangement (34*b*).

8. The climate control device in accordance with claim 7, wherein the Peltier element arrangement (18) is constructed in a form of a flat array of a plurality of individually electrically contacted Peltier elements.

9. The climate control device in accordance with claim 8, wherein the Peltier element arrangement (18) is arranged between the coolant circuit (22*a*) assigned to the cold side (16*a*) of the Peltier element arrangement (18) and the coolant circuit (22*b*) assigned to the warm side (16*b*) of the Peltier element arrangement (18).

10. The climate control device in accordance with claim 9, wherein the coolant circuit (22*a*) assigned to the cold side (16*a*) of the Peltier element arrangement (18) and the coolant circuit (22*b*) assigned to the warm side (16*b*) of the Peltier element arrangement (18) are substantially in a linearly extending manner and extend substantially parallel in relation to each other.

11. The climate control device in accordance with claim 10, wherein the Peltier element arrangement (18) at an end (36*a*) of the coolant circuit (22*a*) assigned to the cold side (16*a*) of the Peltier element arrangement (18) is arranged in a first connection area (38*a*) and is thermally connected with the cold side (16*a*) of the Peltier element arrangement (18), and/or the Peltier element arrangement (18) at an end (36*b*) of the coolant circuit (22*b*) assigned to the warm side (16*b*) of the Peltier element arrangement (18) is arranged in a second connection area (38*b*) and is thermally connected with the warm side (16*b*) of the Peltier element arrangement (18).

12. The climate control device in accordance with claim 11, wherein the first pump device (30*a*) is arranged in a first pump area (40*a*) adjoining the first connection area (38*a*), and/or the second pump device (30*b*) is arranged in a second pump area (40*b*) adjoining the second connection area (38*b*).

13. The climate control device in accordance with claim 12, wherein the first fan arrangement (34*a*) is arranged in a first fan area (42*a*) adjoining the first pump area (40*a*), and/or the second fan arrangement (34*b*) is arranged in a second fan area (42*b*) adjoining the second pump area (40*b*).

14. The climate control device in accordance with claim 13, wherein the air/liquid heat exchanger arrangement (28*a*) for the air (14*a*) to be cooled is arranged in a first heat exchanger area (44*a*) adjoining the first fan area (42*a*), and/or the air/liquid heat exchanger arrangement (28*b*) for the air (14*b*) to be warmed is arranged in a second heat exchanger area (44*b*) adjoining the second fan area (42*b*).

15. The climate control device in accordance with claim 14, wherein the cool air outlet is arranged adjoining the first heat exchanger area (44*a*), and/or the warm air outlet is arranged adjoining the second heat exchanger area (44*b*).

16. The climate control device in accordance with claim 15, wherein the Peltier element arrangement (18) is arranged between the first connection area (38*a*) and the second connection area (38*b*), and the first connection area (38*a*) and the second connection area (38*b*), the first pump area (40*a*) and the second pump area (40*b*), the first fan area (42*a*) and the second fan area (42*b*), and the first heat exchanger area (44*a*) and the second heat exchanger area (44*b*) adjoin each other.

17. The climate control device in accordance with claim 16, wherein the coolant circuit (22*a*) assigned to the cold side (16*a*) of the Peltier element arrangement (18) is arranged in a first partial housing (46*a*), and/or the coolant circuit (22*b*) assigned to the warm side (16*b*) of the Peltier element arrangement (18) is arranged in a second partial housing (46*b*), wherein the first partial housing (46*a*) is arranged parallel to and adjoining the second partial housing (46*b*), and the first partial housing (46*a*) together with the second partial housing (46*b*) form a combined housing (40).

18. The climate control device in accordance with claim 17, wherein the first connection area (38*a*), the first pump area (40*a*), the first fan area (42*a*) and the first heat exchanger area (44*a*) are arranged in the first partial housing (46*a*), and the second connection area (38*b*), the second pump area (40*b*), the second fan area (42*b*) and the second heat exchanger area (44*b*) are arranged in the second partial housing (46*b*).

19. The climate control device in accordance with claim 18, wherein an arrangement of the first connection area (38*a*), the first pump area (40*a*), the first fan area (42*a*) and the first heat exchanger area (44*a*) is constructed mirror-symmetrically with respect to the second connection area (38*b*), the second pump area (40*a*), the second fan area (42*b*) or respectively the second heat exchanger area (44*b*), and wherein a plane defined by the Peltier element arrangement (18) forms a plane of symmetry (50).

20. The climate control device in accordance with claim 19, having a housing with at least one climate control device, wherein at least one wall (90) of the housing (62) has a passage (64) at which the at least one climate control device is arranged, wherein the air (14*a*) to be cooled is conveyed out of an interior (66) of the housing (62) by the cool air conveying device (20*a*) and is blown back into the interior (66) of the housing (62) through the cool air outlet (10*a*), and the ambient air (12*b*) is conveyed out of an exterior chamber (68) of the housing and is blown out into the exterior chamber (68) of the housing (62) through the warm air outlet (10*b*).

21. The housing in accordance with claim 20, wherein the first inlet opening (32*a*) for the air (14*a*) to be cooled and the cool air outlet (10*a*) are spaced apart from each other and open toward the interior (66) of the housing (62).

22. The housing in accordance with claim 21, wherein the second inlet opening (32*b*) for the ambient air (14*b*) and the warm air outlet (10*b*) are spaced apart from each other and open toward the exterior (68) of the housing (62).

23. The climate control device in accordance with claim 19, having a housing with at least one climate control device, wherein at least one of walls of the housing has a passage in which the climate control device is arranged, wherein the air (14*a*) to be heated is conveyed out of the interior of the housing by the warm air conveying device (20*b*) and is blown into the interior of the housing through the warm air outlet (10*b*).

24. The housing in accordance with claim 21, wherein the second inlet opening (32*b*) for the air (14*b*) to be heated and the warm air outlet (10*b*) are spaced apart from each other and open toward the interior of the housing.

25. The climate control device in accordance with claim 2, wherein the coolant circuit (22*a*) assigned to the cold side (16*a*) of the Peltier element arrangement (18) and the coolant circuit (22*b*) assigned to the warm side (16*b*) of the Peltier element arrangement (18) are arranged spatially and thermally separated from each other, and each one is closed in itself.

26. The climate control device in accordance with claim 1, wherein a first pump device (30*a*) is arranged in the coolant circuit (22*a*) assigned to the cold side (16*a*) of the Peltier element arrangement (18), and/or a second pump device (30*a*) is arranged in the coolant circuit (22*b*) assigned to the warm side (16*b*) of the Peltier element arrangement (18).

27. The climate control device in accordance with claim 1, wherein the cool air conveying device (20*a*) has a first inlet opening (32*a*) for the air (14*a*) to be cooled and a first fan arrangement (34*a*) and/or the warm air conveying device (20*b*) has a second inlet opening (32*b*) for air (14*b*) to be heated, and a second fan arrangement (34*b*).

28. The climate control device in accordance with claim 1, wherein the Peltier element arrangement (18) is constructed in a form of a flat array of a plurality of individually electrically contacted Peltier elements.

29. The climate control device in accordance with claim 1, wherein the Peltier element arrangement (18) is arranged between the coolant circuit (22*a*) assigned to the cold side (16*a*) of the Peltier element arrangement (18) and the coolant circuit (22*b*) assigned to the warm side (16*b*) of the Peltier element arrangement (18).

30. The climate control device in accordance with claim 1, wherein the coolant circuit (22*a*) assigned to the cold side (16*a*) of the Peltier element arrangement (18) and the coolant circuit (22*b*) assigned to the warm side (16*b*) of the Peltier element arrangement (18) are substantially in a linearly extending manner and extend substantially parallel in relation to each other.

31. The climate control device in accordance with claim 1, wherein the Peltier element arrangement (18) at an end (36*a*) of the coolant circuit (22*a*) assigned to the cold side (16*a*) of the Peltier element arrangement (18) is arranged in a first connection area (38*a*) and is thermally connected with the cold side (16*a*) of the Peltier element arrangement (18), and/or the Peltier element arrangement (18) at an end (36*b*) of the coolant circuit (22*b*) assigned to the warm side (16*b*) of the Peltier element arrangement (18) is arranged in a second connection area (38*b*) and is thermally connected with the warm side (16*b*) of the Peltier element arrangement (18).

32. The climate control device in accordance with claim 6, wherein the first pump device (30*a*) is arranged in a first pump area (40*a*) adjoining the first connection area (38*a*), and/or the second pump device (30*b*) is arranged in a second pump area (40*b*) adjoining the second connection area (38*b*).

33. The climate control device in accordance with claim 7, wherein the first fan arrangement (34*a*) is arranged in a first fan area (42*a*) adjoining the first pump area (40*a*), and/or the second fan arrangement (34*b*) is arranged in a second fan area (42*b*) adjoining the second pump area (40*b*).

34. The climate control device in accordance with claim 11, wherein the Peltier element arrangement (18) is arranged between the first connection area (38*a*) and the second connection area (38*b*), and the first connection area (38*a*) and the second connection area (38*b*), the first pump area (40*a*) and the second pump area (40*b*), the first fan area (42*a*) and the second fan area (42*b*), and the first heat exchanger area (44*a*) and the second heat exchanger area (44*b*) adjoin each other.

35. The climate control device in accordance with claim 1, wherein the coolant circuit (22*a*) assigned to the cold side (16*a*) of the Peltier element arrangement (18) is arranged in a first partial housing (46*a*), and/or the coolant circuit (22*b*) assigned to the warm side (16*b*) of the Peltier element arrangement (18) is arranged in a second partial housing (46*b*), wherein the first partial housing (46*a*) is arranged parallel to and adjoining the second partial housing (46*b*), and the first partial housing (46*a*) together with the second partial housing (46*b*) form a combined housing (40).

36. The climate control device in accordance with claim 11, wherein an arrangement of the first connection area (38*a*), the first pump area (40*a*), the first fan area (42*a*) and the first heat exchanger area (44*a*) is constructed mirror-symmetrically with respect to the second connection area (38*b*), the second pump area (40*a*), the second fan area (42*b*) or respectively the second heat exchanger area (44*b*), and wherein a plane defined by the Peltier element arrangement (18) forms a plane of symmetry (50).

37. The climate control device in accordance with claim 1, having a housing with at least one climate control device, wherein at least one wall (90) of the housing (62) has a passage (64) at which the at least one climate control device is arranged, wherein the air (14*a*) to be cooled is conveyed out of an interior (66) of the housing (62) by the cool air conveying device (20*a*) and is blown back into the interior (66) of the housing (62) through the cool air outlet (10*a*), and the ambient air (12*b*) is conveyed out of an exterior chamber (68) of the housing and is blown out into the exterior chamber (68) of the housing (62) through the warm air outlet (10*b*).

38. The housing in accordance with claim 20, wherein the second inlet opening (32*b*) for the ambient air (14*b*) and the warm air outlet (10*b*) are spaced apart from each other and open toward the exterior (68) of the housing (62).

39. The climate control device in accordance with claim 1, having a housing with at least one climate control device, wherein at least one of walls of the housing has a passage in which the climate control device is arranged, wherein the air (14*a*) to be heated is conveyed out of the interior of the housing by the warm air conveying device (20*b*) and is blown into the interior of the housing through the warm air outlet (10*b*).

40. The housing in accordance with claim 20, wherein the second inlet opening (32*b*) for the air (14*b*) to be heated and the warm air outlet (10*b*) are spaced apart from each other and open toward the interior of the housing.

* * * * *